US010591861B2

(12) United States Patent
Ueno

(10) Patent No.: US 10,591,861 B2
(45) Date of Patent: Mar. 17, 2020

(54) IMAGE FORMING APPARATUS THAT REDUCES CONVEYANCE FAILURE OF SHEET BASED ON MOTOR TORQUE VARIATION

(71) Applicant: KYOCERA Document Solutions Inc., Osaka (JP)

(72) Inventor: Daijiro Ueno, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 288 days.

(21) Appl. No.: 15/847,018

(22) Filed: Dec. 19, 2017

(65) Prior Publication Data

US 2018/0181046 A1 Jun. 28, 2018

(30) Foreign Application Priority Data

Dec. 28, 2016 (JP) ..... 2016-255190

(51) Int. Cl.
*G03G 15/00* (2006.01)
*B65H 7/20* (2006.01)
*G03G 21/14* (2006.01)

(52) U.S. Cl.
CPC ..... *G03G 15/5062* (2013.01); *B65H 7/20* (2013.01); *G03G 15/6529* (2013.01); *G03G 15/6558* (2013.01); *G03G 15/55* (2013.01); *G03G 21/14* (2013.01); *G03G 2215/00599* (2013.01); *G03G 2215/00746* (2013.01); *G03G 2215/00945* (2013.01)

(58) Field of Classification Search
CPC ..... G03G 15/6529; G03G 15/6558; G03G 15/55; G03G 21/14; G03G 15/602; G03G 15/6564; G03G 21/145; G03G 2215/00599; G03G 2215/00746; G03G 2215/00945; B65H 7/00; B65H 7/20; B65H 5/062; B65H 2403/92; B65H 2513/106; B65H 2513/104
See application file for complete search history.

(56) References Cited

U.S. PATENT DOCUMENTS

2009/0309291 A1* 12/2009 Yasui ..... B65H 3/44 271/9.01
2014/0205340 A1* 7/2014 Yamaguchi ..... G03G 15/602 399/396
2017/0001822 A1* 1/2017 Asano ..... B65H 5/062

FOREIGN PATENT DOCUMENTS

JP 2000-283934 A 10/2000

* cited by examiner

*Primary Examiner* — David H Bollinger
(74) *Attorney, Agent, or Firm* — Stein IP, LLC

(57) ABSTRACT

An image forming apparatus includes at least one conveyance roller pair, an image forming unit, at least one brushless motor, a motor drive control unit, a delay amount detector, and an image formation control unit. The image formation control unit controls the motor drive control unit to convey the sheets at a predetermined timing toward the image forming unit. The image formation control unit, during a continuous image formation in which a plurality of sheets are continuously conveyed by the conveyance roller pair with a predetermined sheet spacing and images are sequentially formed on the respective sheets, controls the motor drive control unit to sequentially perform an on and off control of the brushless motor corresponding to the respective sheets, and adjusts the sheet spacing and a rise time in the on control of the brushless motor corresponding to the rotation delay amount detected by the delay amount detector.

11 Claims, 12 Drawing Sheets

IMAGE FORMING APPARATUS THAT REDUCES CONVEYANCE FAILURE OF SHEET BASED ON MOTOR TORQUE VARIATION

INCORPORATION BY REFERENCE

This application is based upon, and claims the benefit of priority from, corresponding Japanese Patent Application No. 2016-255190 filed in the Japan Patent Office on Dec. 28, 2016, the entire contents of which are incorporated herein by reference.

BACKGROUND

Unless otherwise indicated herein, the description in this section is not prior art to the claims in this application and is not admitted to be prior art by inclusion in this section.

A typical image forming apparatus, such as a copying machine, a printer, a facsimile, or a multi-functional peripheral including these functions, is equipped with a sheet conveyance apparatus that conveys a sheet. Such sheet conveyance apparatus includes a conveyance roller pair that forms a nip portion where the sheet passes. A rotary drive power being input to one roller of the conveyance roller pair from a driving unit causes the conveyance roller pair in convey the sheet to a predetermined conveyance direction.

Recently, in order to improve a productivity of the image forming apparatus, there has been developed a technique that variably controls sheet conveyance speeds and decreases a spacing between sheets. In order to control the sheet conveyance speed, a stepper motor is typically selected as a driving unit. However, since the stepper motor has a large power consumption, a servo control of a brushless motor is recently getting to be a mainstream, especially, a brushless motor of an inner brushless type is often employed. There has been proposed a technique in which the brushless motor generates the rotary drive power input to the conveyance roller.

SUMMARY

An image forming apparatus according to one aspect of the disclosure includes at least one conveyance roller pair, an image forming unit, at least one brushless motor, a motor drive control unit, a delay amount detector, and an image formation control unit. The at least one conveyance roller pair includes a conveyance roller and a facing roller. The conveyance roller is rotationally driven at a predetermined rotation speed to convey sheets. The facing roller that forms a nip portion with the conveyance roller through which the sheets pass. The image forming unit forms images on the sheets conveyed by the conveyance roller pair. The at least one brushless motor outputs a rotation speed signal. The brushless motor generates a rotary drive power that rotationally drives the conveyance roller. The motor drive control unit outputs an input signal corresponding to the rotation speed of the conveyance roller to the brushless motor to control the brushless motor. The delay amount detector detects a rotation delay amount of the brushless motor from the input signal and the rotation speed signal. The image formation control unit controls the image forming unit so as to form predetermined images. The image formation control unit controlling the motor drive control unit to convey the sheets at a predetermined timing toward the image forming unit. The image formation control unit, during a continuous image formation in which a plurality of sheets are continuously conveyed by the conveyance roller pair with a predetermined sheet spacing and images are sequentially formed on the respective sheets, controls the motor drive control unit to sequentially perform an on and off control of the brushless motor corresponding to the respective sheets, and adjusts the sheet spacing and a rise time in the on control of the brushless motor corresponding to the rotation delay amount detected by the delay amount detector.

These as well as other aspects, advantages, and alternatives will become apparent to those of ordinary skill in the art by reading the following detailed description with reference where appropriate to the accompanying drawings. Further, it should be understood that the description provided in this summary section and elsewhere in this document is intended to illustrate the claimed subject matter by way of example and not by way of limitation.

DETAILED DESCRIPTION

Figure 1:
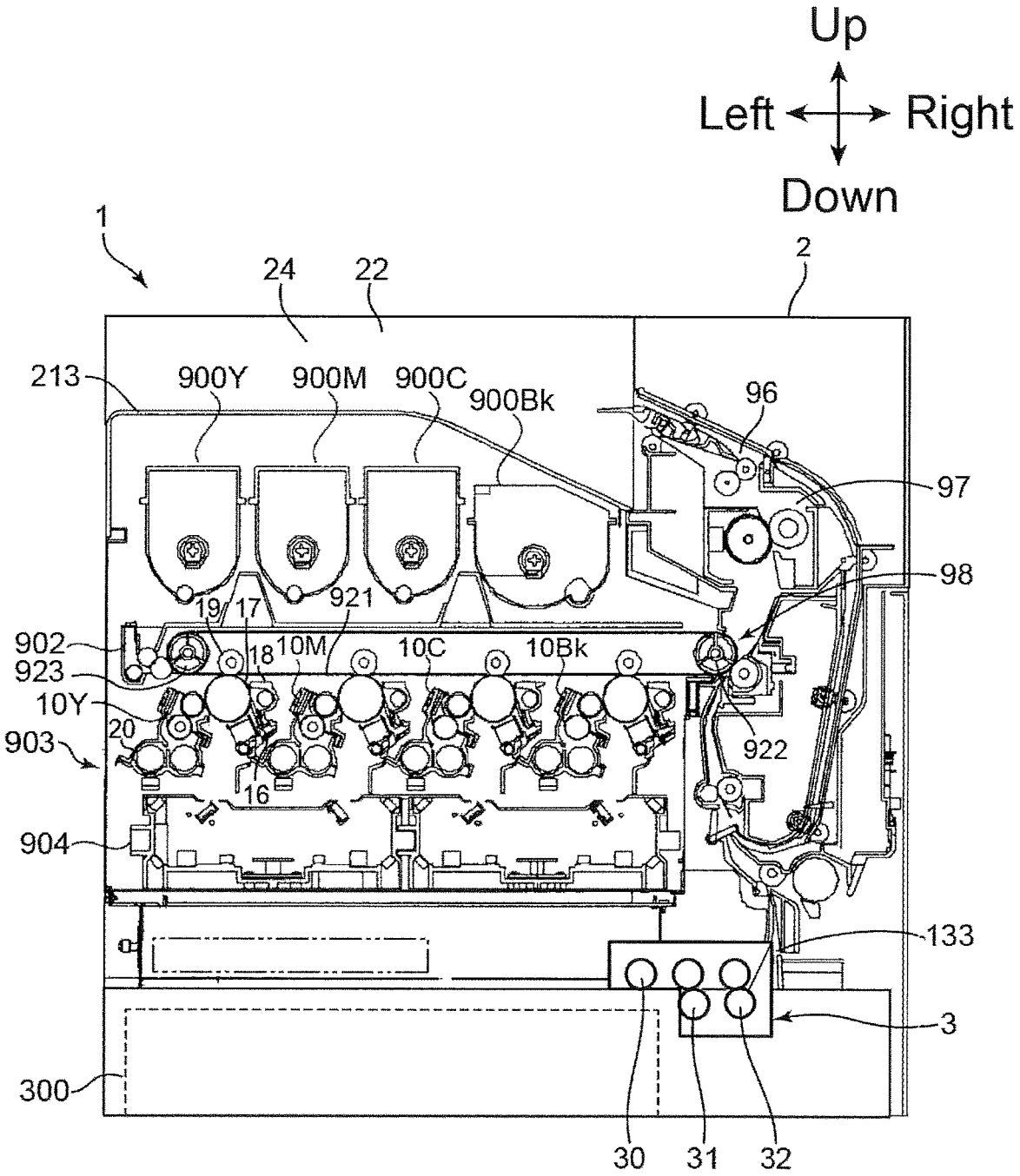
FIG. 1 illustrates a cross-sectional view of an image forming apparatus according to one embodiment of the disclosure.

Example apparatuses are described herein. Other example embodiments or features may further be utilized, and other changes may be made, without departing from the spirit or scope of the subject matter presented herein. In the following detailed description, reference is made to the accompanying drawings, which form a part thereof.

The example embodiments described herein are not meant to be limiting. It will be readily understood that the aspects of the present disclosure, as generally described herein, and illustrated in the drawings, can be arranged, substituted, combined, separated, and designed in a wide variety of different configurations, all of which are explicitly contemplated herein.

The following describes one embodiment of the disclosure with reference to the drawings. In the following description, a term of "sheet" includes a copy paper, a coated paper, an OHP sheet, a cardboard, a postcard, a tracing paper and other sheet members on which an image formation process is performed, or sheet members to which any process other than the image formation process is performed.

FIG. 1 illustrates a cross-sectional view schematically illustrating an internal structure of an image forming apparatus 1 according to the one embodiment of the disclosure. While the image forming apparatus 1 is a top surface paper discharge type printer, in another embodiment, a copier, a facsimile device, a multi-functional peripheral including these functions, and another device to form a toner image onto a sheet may be employed. Especially, when a reading device (not illustrated) is arranged above the image forming apparatus 1 according to the following embodiment, these devices function as what is called an in-barrel paper discharge type copier.

The image forming apparatus 1 forms an image onto a sheet corresponding to image information transmitted from an image information transmitting device, such as a personal computer. The image forming apparatus 1 includes a main chassis 2 (housing) in an approximately rectangular parallelepiped shape. The main chassis 2 has a top surface portion where a discharge space 24 is formed. A sheet on which a printing process is performed is discharged to the discharge space 24.

The main chassis 2 includes a sheet feed tray 300 in which a plurality of sheets are loaded. The sheet feed tray 300 is configured to be pulled out in a forward direction from the main chassis 2. The sheet housed within the sheet feed tray 300 is sent out to an upper side inside the main chassis 2. Based on an instruction input by a user through, for example, the image information transmitting device, an image formation process is performed to the sheet inside the main chassis 2. Then, the sheet is discharged to a paper sheet discharge unit 213 in the discharge space 24.

Figure 2:
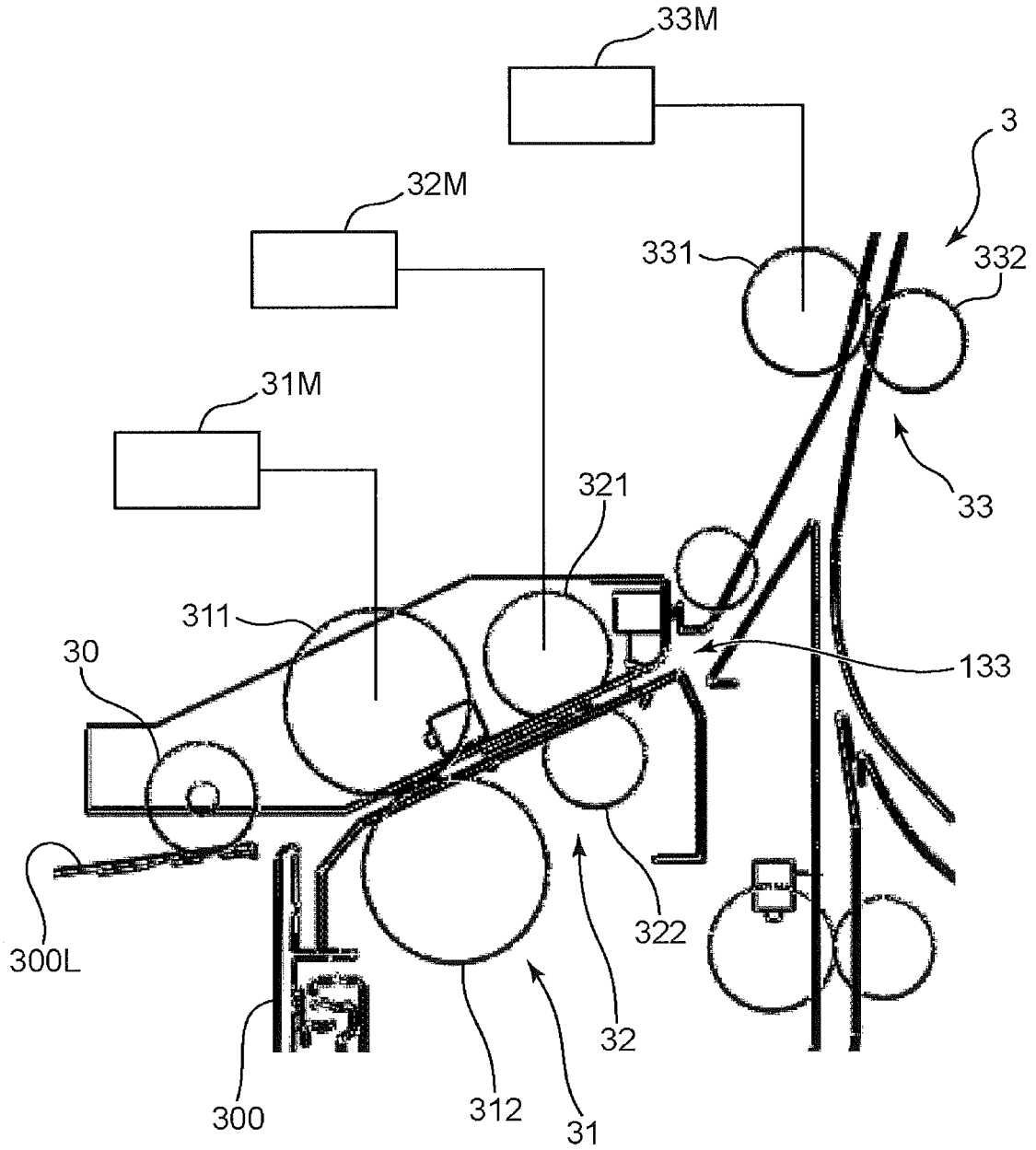
FIG. 2 illustrates a cross-sectional view of a periphery of a conveyance unit of the image forming apparatus according to the one embodiment.

The sheet feed tray 300 includes a lift plate 300L (see FIG. 2). The plurality of sheets are loaded on the lift plate 300L. The lift plate 300L upwardly pushes up a forward end side in a conveyance direction of the sheet to bring the sheet into contact with a pickup roller 30, which will be described later.

The main chassis 2 houses toner containers 900Y, 900M, 900C, and 900Bk, an intermediate transfer unit 902, an image forming unit 903, an exposure unit 904, a fixing unit 97, a sheet discharge unit 96, and a conveyance unit 3.

The image forming unit 903 forms a toner image onto a sheet conveyed by a feed roller pair 31, a first conveyance roller pair 32, and a second conveyance roller pair 33, which will be described later. The image forming unit 903 includes the toner container for yellow 900Y, the toner container for magenta 900M, the toner container for cyan 900C, and the toner container for black 900Bk. Below these containers, developing devices 10Y, 10M, 10C, and 10Bk that correspond to respective colors of YMCBk are each arranged.

The image forming unit 903 includes photoreceptor drums 17 that carry toner images in the respective colors. The respective photoreceptor drums 17 are supplied with the respective toners of yellow, magenta, cyan, and black from the toner containers 900Y, 900M, 900C, and 900Bk. Peripheral areas of the photoreceptor drums 17 include chargers 16, developing devices 10 (10Y, 10M, 10C, and 10Bk), transfer rollers 19, and cleaning apparatuses 18. The respective developing devices 10Y, 10M, 10C, and 10Bk include development housings 20. The development housing 20 internally houses two-component developer that contains a magnetic carrier and a toner. The exposure unit 904 includes various kinds of optical system apparatuses, such as a light source, a polygon mirror, a reflection mirror, and a deflecting mirror. The exposure unit 904 irradiates circumference surfaces of the photoreceptor drums 17, which are individually located, of the image forming unit 903 with a light based on image data to form electrostatic latent images.

The intermediate transfer unit 902 includes an intermediate transfer belt 921, a drive roller 922, and a driven roller 923. On the intermediate transfer belt 921, the toner images are overlaid by a plurality of the photoreceptor drums 17 (primary transfer). The overlaid toner images are secondarily transferred onto a sheet, which is supplied from the sheet feed tray 300, in a secondary transfer unit 98. The drive roller 922 and the driven roller 923 that circularly drives the intermediate transfer belt 921 are rotatably supported by the main chassis 2.

The fixing unit 97 performs a fixing process to the toner images on the sheet secondarily transferred by the intermediate transfer unit 902. The sheet with a fixing processed color image is discharged toward the sheet discharge unit 96 formed in an upper portion of the fixing unit 97. The sheet discharge unit 96 discharges the sheet conveyed from the fixing unit 97 to the discharge space 24.

The conveyance unit 3 is arranged opposing to the sheet feed tray 300 in the main chassis 2. FIG. 2 illustrates a cross-sectional view of a periphery of the conveyance unit 3 according to the embodiment. The conveyance unit 3 includes the pickup roller 30, the feed roller pair 31 (conveyance roller pair), the first conveyance roller pair 32 (conveyance roller pair), and the second conveyance roller pair 33 (conveyance roller pair).

The pickup roller 30 is in abutting contact with a sheet housed in the sheet feed tray 300 and sends out the sheet toward a sheet conveyance path 133.

The feed roller pair 31 is arranged in a downstream side in the sheet conveyance direction of the pickup roller 30. The feed roller pair 31 includes a feed roller 311 (conveyance roller) and a retard roller 312 (facing roller). The feed roller 311 is rotationally driven at a predetermined rotation speed and further conveys the sheet sent out by the pickup roller 30 to the downstream side in the sheet conveyance direction. The retard roller 312 forms a nip portion with the feed roller 311 through which the sheets pass. The retard roller 312 also includes a function to prevent the plurality of sheets are conveyed by the feed roller 311.

The first conveyance roller pair 32 is arranged in a downstream side in the sheet conveyance direction of the feed roller pair 31. The first conveyance roller pair 32 includes a first conveyance roller 321 (conveyance roller) and a first driven roller 322 (facing roller). The first conveyance roller 321 is rotationally driven at a predetermined rotation speed and further conveys the sheet sent out by the feed roller 311 to the downstream side in the sheet conveyance direction. The first driven roller 322 is rotationally driven by following the first conveyance roller 321 and forms a nip portion with the first conveyance roller 321 through which the sheets pass.

Similarly, the second conveyance roller pair 33 is arranged in a downstream side in the sheet conveyance direction of the first conveyance roller pair 32. The second conveyance roller pair 33 includes a second conveyance roller 331 (conveyance roller) and a second driven roller 332 (facing roller). The second conveyance roller 331 is rotationally driven at a predetermined rotation speed and further conveys the sheet sent out by the first conveyance roller 321 to the downstream side in the sheet conveyance direction. The second driven roller 332 is rotationally driven by following the second conveyance roller 331 and forms a nip portion with the second conveyance roller 331 through which the sheets pass.

Furthermore, the conveyance unit 3 includes a paper feeding motor 31M, a first motor 32M, and a second motor 33M. The paper feeding motor 31M, the first motor 32M, and the second motor 33M are all made of brushless motors. The paper feeding motor 31M generates a rotary drive power that rotationally drives the pickup roller 30 and the feed roller 311. The first motor 32M generates a rotary drive power that rotationally drives the first conveyance roller 321. The second motor 33M generates a rotary drive power that rotationally drives the second conveyance roller 331. In the following description, the paper feeding motor 31M, the first motor 32M, and the second motor 33M are collectively referred to as the brushless motors. These brushless motors are all configured to output rotation speed signals as described below.

The pickup roller 30 and the feed roller 311 located in the conveyance unit 3 being rotationally driven takes out a sheet on an uppermost layer of a sheet bundle inside the sheet feed tray 300 one by one. Furthermore, the first conveyance roller pair 32 and the second conveyance roller pair 33 bring up the sheet to a downstream of the sheet conveyance path 133 and the sheet is inducted into the image forming unit 903.

Figure 3:
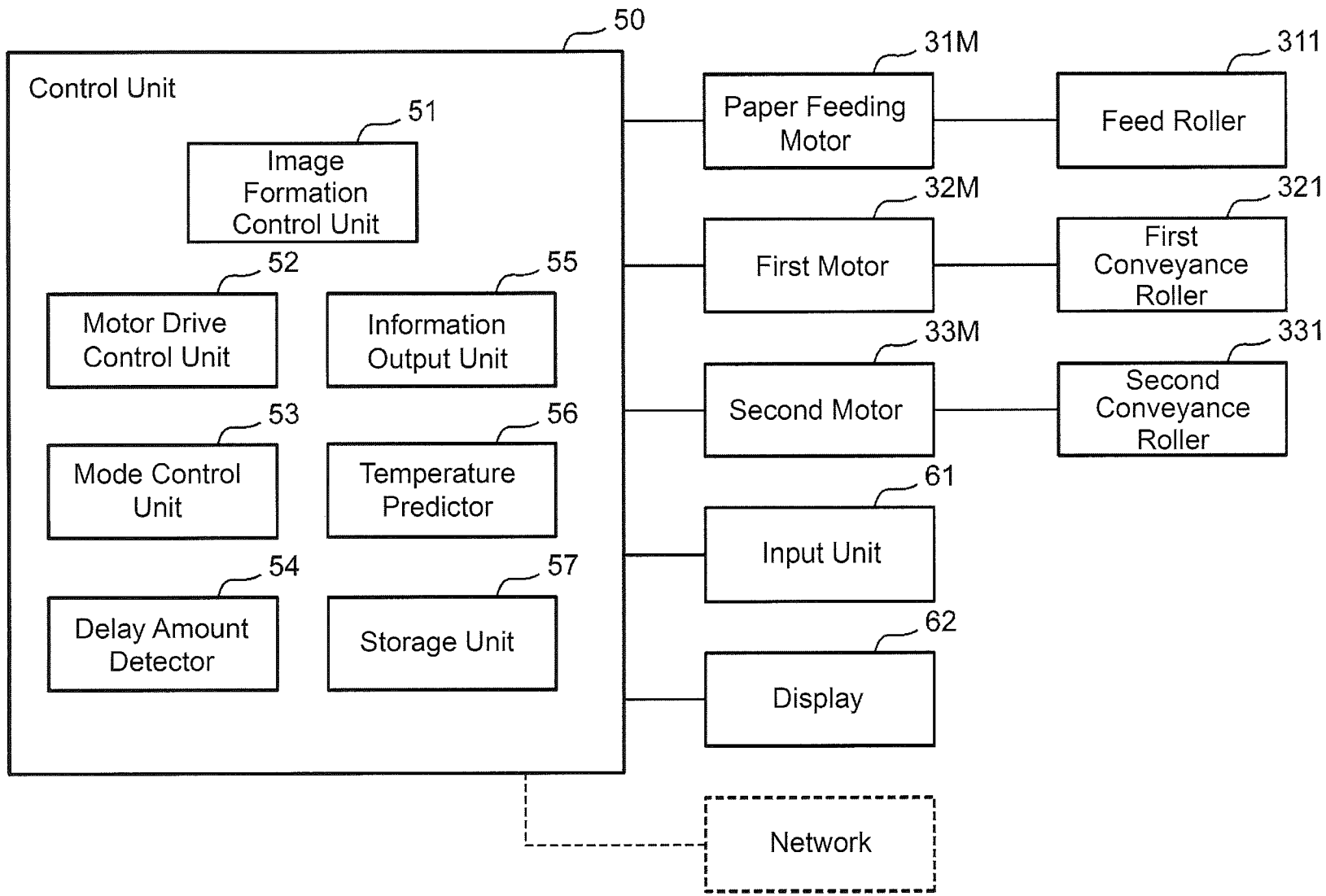
FIG. 3 illustrates a block diagram of a control unit of the image forming apparatus according to the one embodiment.

The image forming apparatus 1 includes a control unit 50 that generally controls operations of respective units of the image forming apparatus 1. FIG. 3 illustrates a block diagram of the control unit 50 of the image forming apparatus 1 according to the embodiment.

The control unit 50 is constituted of, for example, a Central Processing Unit (CPU), a Read Only Memory (ROM) that stores a control program, and a Random Access Memory (RAM) used as a work area of the CPU. In addition to the image forming unit 903, the paper feeding motor 31M, the first motor 32M, and the second motor 33M described above, for example, an input unit 61 and a display 62 are electrically connected to the control unit 50. The control unit 50 is connected to the network (see FIG. 3) in order to transmit operation information and failure information on the image forming apparatus 1 to an information management center in a remote location.

The input unit 61 is included in an operation unit (not illustrated) of the image forming apparatus 1. The input unit 61 accepts an input of a count of job printed sheet in image formation. The count of job printed sheet is a count of the plurality of sheets on which images are continuously formed during continuous image formation of the image forming apparatus 1.

The display 62 is included in the operation unit of the image forming apparatus 1. The display 62 displays, for example, the operation information on the image forming apparatus 1. The display 62 displays the failure information output by an information output unit 55, which will be described later.

The control unit 50 functions so as to include an image formation control unit 51, a motor drive control unit 52, a mode control unit 53, a delay amount detector 54, the information output unit 55, a temperature predictor 56 (property value predictor), and a storage unit 57 by the CPU executing the control program stored in the ROM.

The image formation control unit 51 controls the respective units of the image forming apparatus 1 so as to unify image forming operations in the image forming apparatus 1. Especially, the image formation control unit 51 controls the image forming unit 903 so as to form a predetermined image and controls the motor drive control unit 52 to convey the sheet toward the secondary transfer unit of the image forming unit 903 at a predetermined timing.

The motor drive control unit 52 outputs input signals that correspond to the rotation speeds of the respective conveyance rollers to the above-described brushless motors to control the brushless motors.

The mode control unit 53 instructs an image forming mode of the image forming apparatus 1 to the image formation control unit 51. The image forming mode includes a normal productivity mode, a low productivity mode, and a cooling mode.

The delay amount detector 54 detects rotation delay amounts (also referred to as delay angles d) of the respective brushless motors from the input signals output to the respective brushless motors by the motor drive control unit 52 and the rotation speed signals output by the respective brushless motors.

The information output unit 55 outputs the failure information on the brushless motor or another member connected to the brushless motor when the rotation delay amount detected by the delay amount detector 54 exceeds a preliminarily set predetermined threshold value (a fourth threshold value).

The temperature predictor 56 predicts an operation property value of the brushless motor from the rotation delay amount detected by the delay amount detector 54 and relationship information stored in the storage unit 57. In this embodiment, the operation property value of the brushless motor is a temperature of the brushless motor.

The storage unit 57 preliminarily stores various kinds of threshold values and parameters required in the image forming operation of the image forming apparatus 1 and a sheet conveying operation of the conveyance unit 3. Especially, the storage unit 57 preliminarily stores relationship information between the rotation delay amount of the brushless motor and the operation property value (temperature) of the brushless motor.

Figure 4:
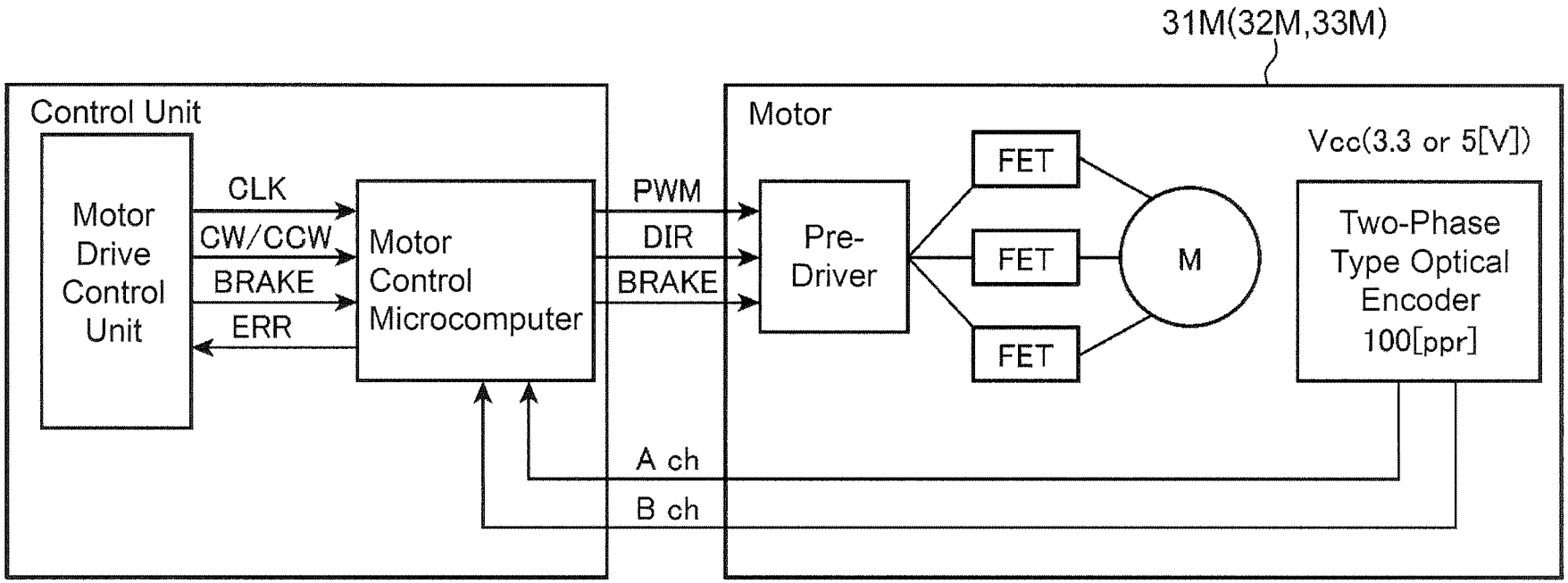
FIG. 4 illustrates a block diagram illustrating an electrical connection relationship between the control unit of the image forming apparatus and a brushless motor according to the one embodiment.

FIG. 4 illustrates a block diagram illustrating an electrical connection relationship between the control unit 50 of the image forming apparatus 1 and the brushless motor (31M, 32M, and 33M). FIG. 4 illustrates a connection state between a motor control microcomputer included in the motor drive control unit 52 of the control unit 50 and the paper feeding motor 31M. The first motor 32M and the second motor 33M are also connected to the control unit 50 similarly to the paper feeding motor 31M in FIG. 4.

In FIG. 4, among a plurality of signals output to the motor control microcomputer by the motor drive control unit 52, a CLK signal corresponds to the input signal that corresponds to the rotation speed of the conveyance roller of the disclosure. This CLK signal is made of a rectangular wave signal of 5 V accompanied by a frequency that corresponds to the above-described rotation speed. The motor control microcomputer accepts this CLK signal and converts the CLK signal to a predetermined PWM signal (0 to 256). Then, the PWM signal that corresponds to the rotation speed of the conveyance roller being input to a pre-driver of the paper feeding motor 31M from the motor control microcomputer rotationally drives a motor main body M of the paper feeding motor 31M. In FIG. 4, while it is illustrated in an aspect that the motor drive control unit 52 outputs a CW/CCW signal, the brushless motor of the disclosure may be rotationally driven only in a forward direction.

On the other hand, the paper feeding motor 31M includes a known two-phase type optical encoder (rotation speed detector) as illustrated in FIG. 4. A signal (rotation speed signal) that corresponds to an actual rotation speed of the paper feeding motor 31M detected by this optical encoder is input to the control unit 50 via an A ch signal line in FIG. 4. This signal is referenced by the above-described delay amount detector 54.

Figure 5:
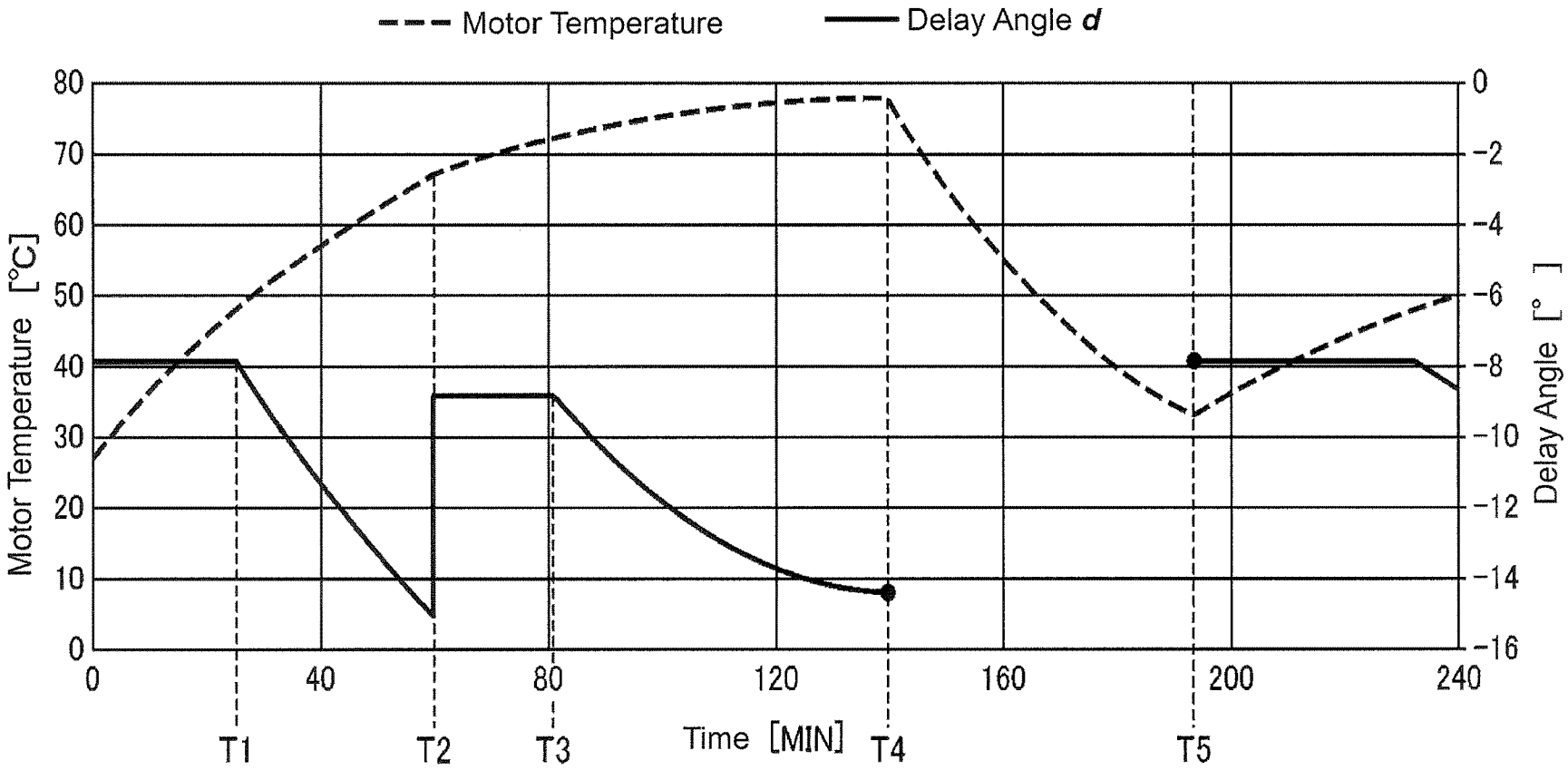
FIG. 5 illustrates a graph illustrating transitions of temperature and rotation delay amount of the brushless motor during continuous image formation in the image forming apparatus according to the one embodiment.
Figure 6:
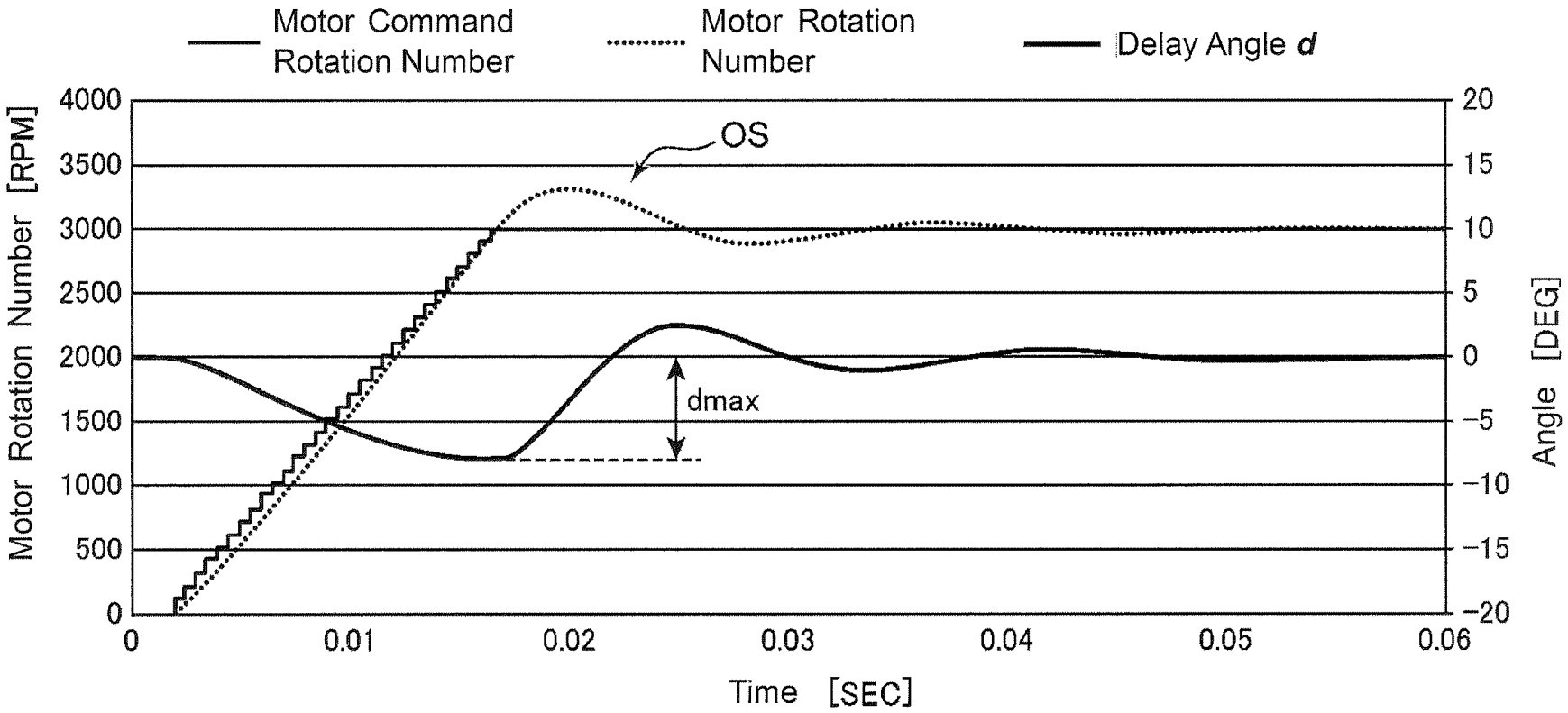
FIG. 6 illustrates a graph illustrating transitions of rotation number and rotation delay amount of the brushless motor at a launch of the motor in the image forming apparatus according to the one embodiment.
Figure 7:
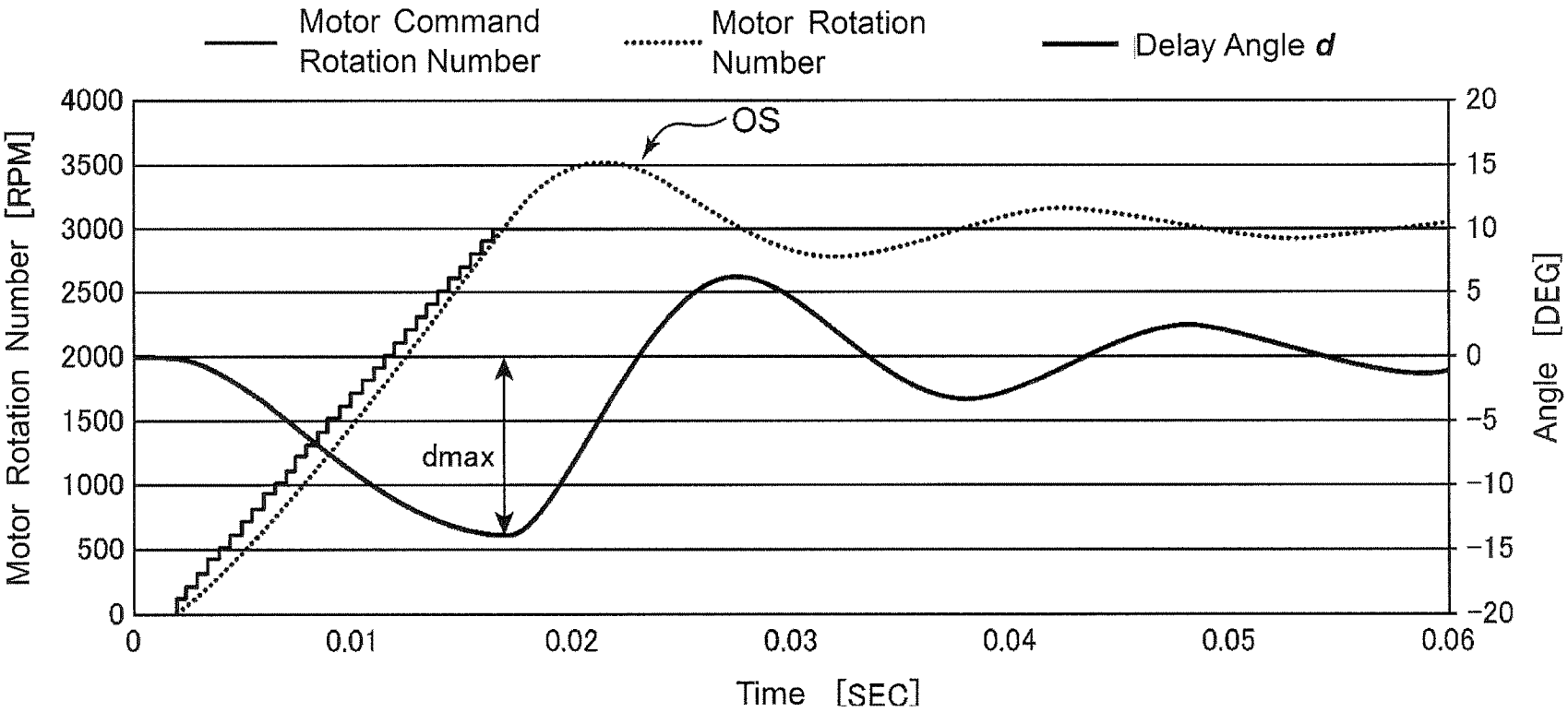
FIG. 7 illustrates a graph illustrating transitions of rotation number and rotation delay amount of the brushless motor at a launch of the motor in the image forming apparatus according to the one embodiment.
Figure 8:
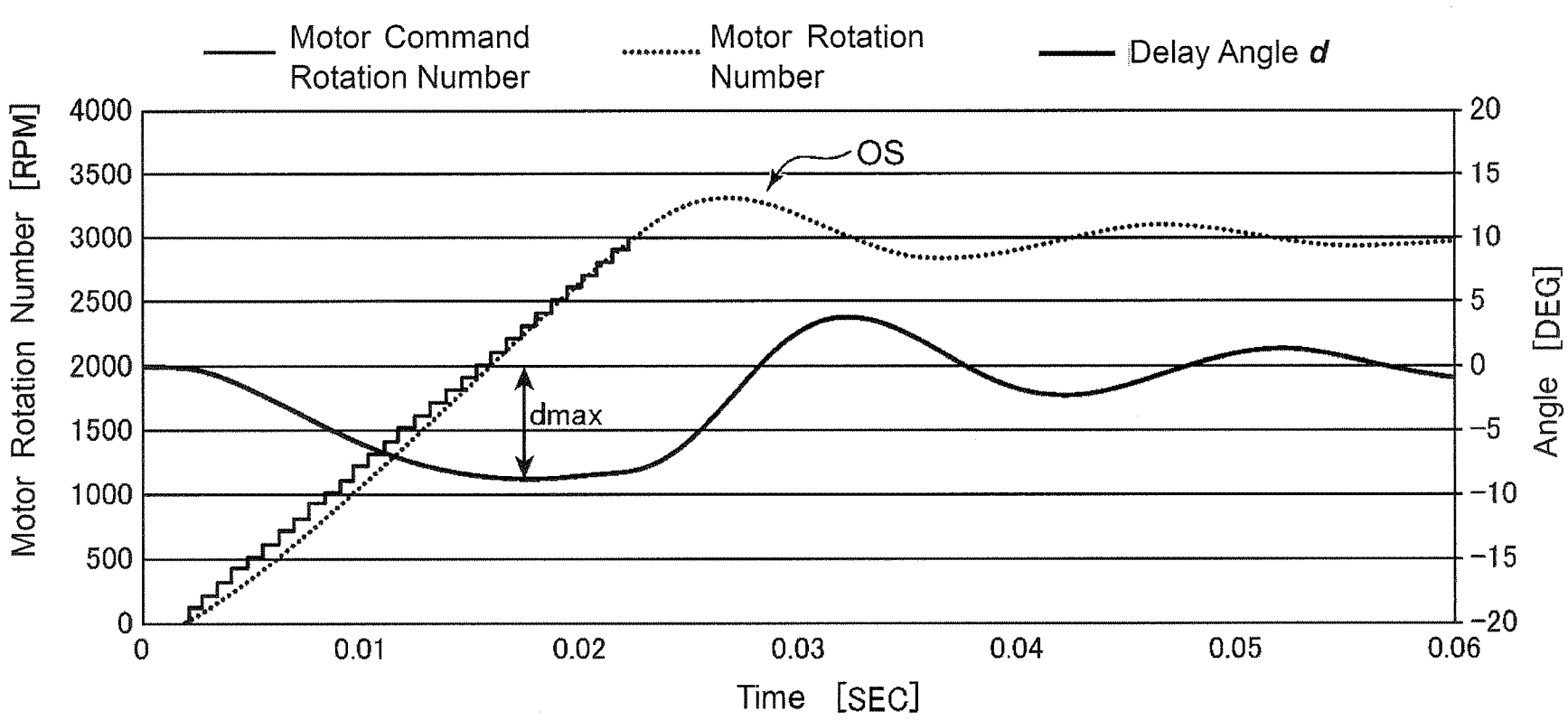
FIG. 8 illustrates a graph illustrating transitions of rotation number and rotation delay amount of the brushless motor at a launch of the motor in the image forming apparatus according to the one embodiment.

FIG. 5 illustrates a graph illustrating transitions of the temperature and the rotation delay amount of the brushless motor during the continuous image formation in the image forming apparatus 1. FIGS. 6 to 8 illustrate graphs illustrating transitions of rotation number and the rotation delay amount of the brushless motor at a launch of the motor in the image forming apparatus 1.

As described above, in this embodiment, the conveyance unit 3 of the image forming apparatus 1 includes three conveyance roller pairs (the feed roller pair 31, the first conveyance roller pair 32, and the second conveyance roller pair 33). Then, the motors (the paper feeding motor 31M, the first motor 32M, and the second motor 33M) that rotationally drive these rollers are made of the brushless motors. In order to stably convey the sheet from the sheet feed tray 300 toward the image forming unit 903, it is necessary that these motors are accurately synchronized. For example, when the rotation of the first conveyance roller pair 32 delays with respect to that of the second conveyance roller pair 33, the second conveyance roller pair 33 excessively pulls the sheet to give a load on the sheet. When the rotation of the second conveyance roller pair 33 delays with respect to that of the first conveyance roller pair 32, the sheet sags between the first conveyance roller pair 32 and the second conveyance roller pair 33. The brushless motor has an advantage that a power consumption is decreased compared with a known stepper motor. However, when the temperature of the motor rises and a rotating torque of the brushless motor decreases, there occurs a problem that the sheet cannot be stably conveyed. In the brushless motor, when the rotation continues, a demagnetization phenomenon occurs in a magnet inside the motor due to a temperature rise, thereby easily decreasing the rotating torque. Such problem occurs when the conveyance unit 3 includes at least one brushless motor. When a plurality of the brushless motors rotationally drive the respective conveyance rollers like this embodiment, it is specifically necessary that the motor control is accurately executed.

In order to solve such problem, in this embodiment, the control unit 50 performs a rotation control of the brushless motor to ensure stably maintaining a productivity of the image forming apparatus 1. FIG. 5 illustrates a state where the continuous image forming operation is executed from Time 0 (min) in the image forming apparatus 1 according to the embodiment. In the continuous image forming operation, the plurality of sheets are continuously conveyed by the pickup roller 30, the feed roller pair 31, the first conveyance roller pair 32, and the second conveyance roller pair 33 with a predetermined sheet spacing. Images are sequentially formed on the respective sheets by the image forming unit 903. In FIG. 5, the delay angle (rotation delay amount) of the paper feeding motor 31M among the plurality of brushless motors is illustrated as a representative. In the image forming apparatus 1, the normal productivity mode is executed by the mode control unit 53 of the control unit 50 as a mode in which the images are formed on the sheets at a normal printing speed. As one example, in the normal productivity mode, the images are formed on the sheets at a speed of 150 sheets/minute.

In FIG. 5, when the continuous image forming operation continues, eventually at Time T1, the delay angle of the feed roller 311 increases to a negative side. That is, an actual rotation speed of the paper feeding motor 31M starts to delay with respect to the input signal output by the motor drive control unit 52 of the control unit 50 and input to the paper feeding motor 31M. FIG. 6 illustrates a state at a launch of the paper feeding motor 31M for one sheet at this Time T1. Since a motor rotation number of the paper feeding motor 31M is less than a motor command rotation number (input signal) output by the motor drive control unit 52, the delay angle d of the paper feeding motor 31M increases and a maximum value dmax of the delay angle d is approximately 7.8 degrees. This much delay angle d does not have a large influence on a sheet conveyability. As illustrated in FIG. 6, the rotation speed of the paper feeding motor 31M slightly has an overshooting region OS even after reaching a target rotation speed. In view of this, the delay angle of the paper feeding motor 31M eventually converges on 0. However, when an initial delay angle increases, the conveyability of the sheet gets worse.

Meanwhile, as illustrated in FIG. 5, when the continuous image forming operation further continues from Time T1, the maximum value dmax of the delay angle of the paper feeding motor 31M is approximately 14.8 degrees at Time T2. FIG. 7 illustrates a state at a launch of the paper feeding motor 31M for one sheet at this Time T2. As one example, when the maximum value dmax exceeds 15 degrees, the influence on the sheet conveyability is apprehended. Here, in this embodiment, at Time T2, the mode control unit 53 of the control unit 50 transitions from the normal productivity mode to the low productivity mode. While the conveyance speed of the sheet inside the sheet conveyance path 133 in the low productivity mode is identical to that of the normal productivity mode, the image formation control unit 51 controlling the motor drive control unit 52 and the sheet spacing being set large decrease the productivity of the image forming apparatus 1 down to 120 sheets/minute.

Since the sheet spacing is set large in the low productivity mode, a rise time for the paper feeding motor 31M to have a target rotation speed is set long. As a result, even if the target rotation speed is identical, the delay angle d of the paper feeding motor 31M decreases. FIG. 8 illustrates a state at a rise of the paper feeding motor 31M for one sheet between Times T2 to T3 after the mode control unit 53 transitions to the low productivity mode. In FIG. 8, the maximum value dmax of the delay angle d of the paper feeding motor 31M is approximately 8.8 degrees. Accordingly, during the continuous image formation, while each of the sheets is stably conveyed, the images can be formed.

Figure 9:
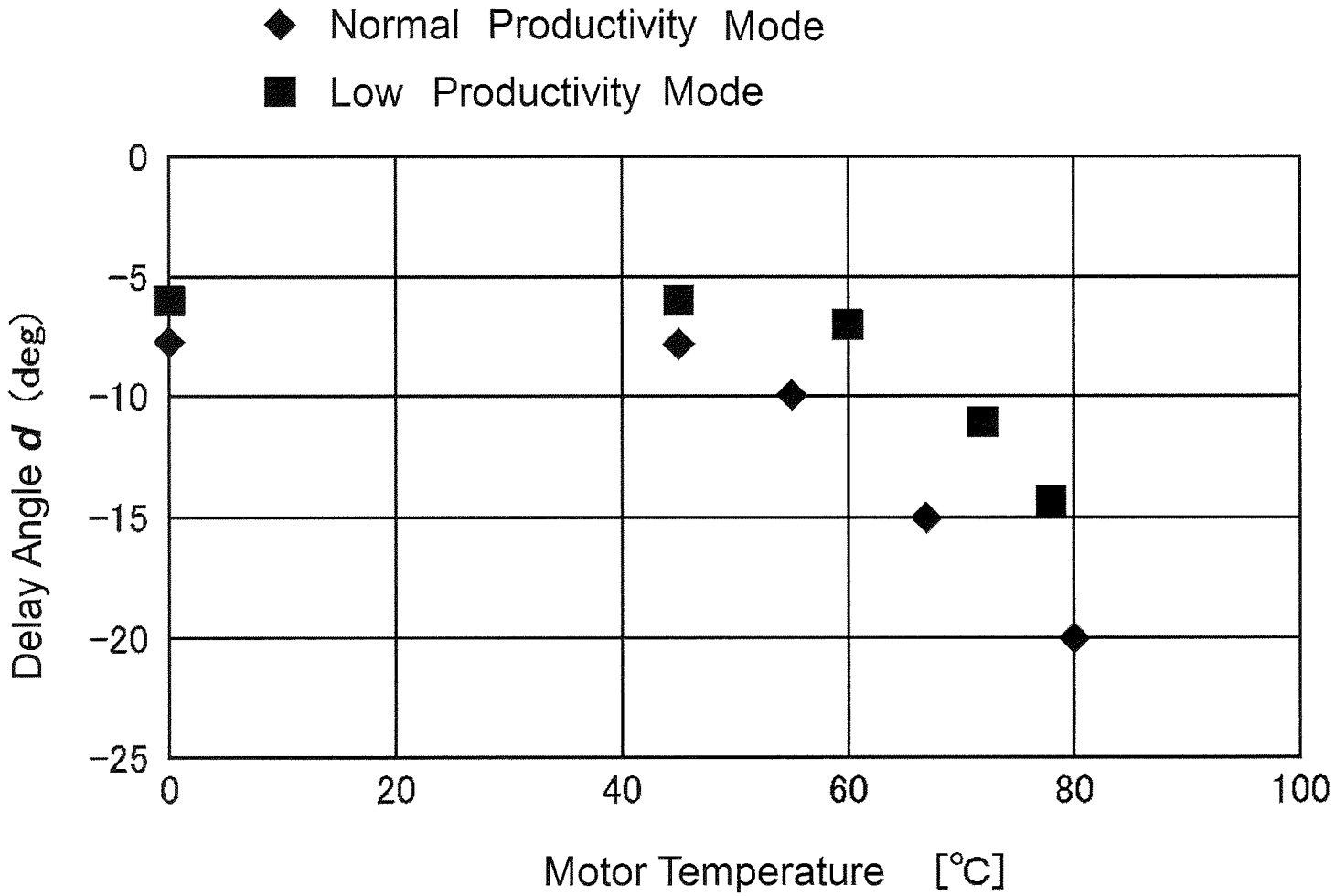
FIG. 9 illustrates a graph illustrating a relationship between temperatures and rotation delay amounts of the brushless motor in the image forming apparatus according to the one embodiment.

FIG. 9 illustrates a graph illustrating a relationship between the temperature and the rotation delay amount of the brushless motor according to the embodiment. As illustrated in FIG. 9, in the low productivity mode in which the sheet spacing is set large, the delay angle (negative portion)

of the motor is maintained small even at an identical temperature compared with the normal productivity mode.

Here, even after the mode control unit 53 transitions to the low productivity mode, the delay angle of the paper feeding motor 31M eventually starts to increase from Time T3 in FIG. 5 when the continuous image forming operation is executed. Then, at Time T4, it is determined that the temperature of the paper feeding motor 31M approaches an allowable temperature (80° C. in this embodiment), and the mode control unit 53 of the control unit 50 transitions from the low productivity mode to the cooling mode. In the cooling mode, the image formation control unit 51 forcibly stops the image forming operation in the image forming unit 903 and the rotation of the paper feeding motor 31M (the first motor 32M and the second motor 33M) temporarily. As a result, the temperature of the paper feeding motor 31M gradually decreases (see FIG. 5).

After a predetermined stop time elapses, at Time T5, the image formation control unit 51 resumes the image forming operation in the image forming unit 903 and the rotation of the paper feeding motor 31M (the first motor 32M and the second motor 33M), and the continuous image forming operation is executed. In this respect, the mode control unit 53 may resume the image forming mode of the image forming apparatus 1 with the normal image forming mode or may resume with the low productivity mode.

Figure 10:
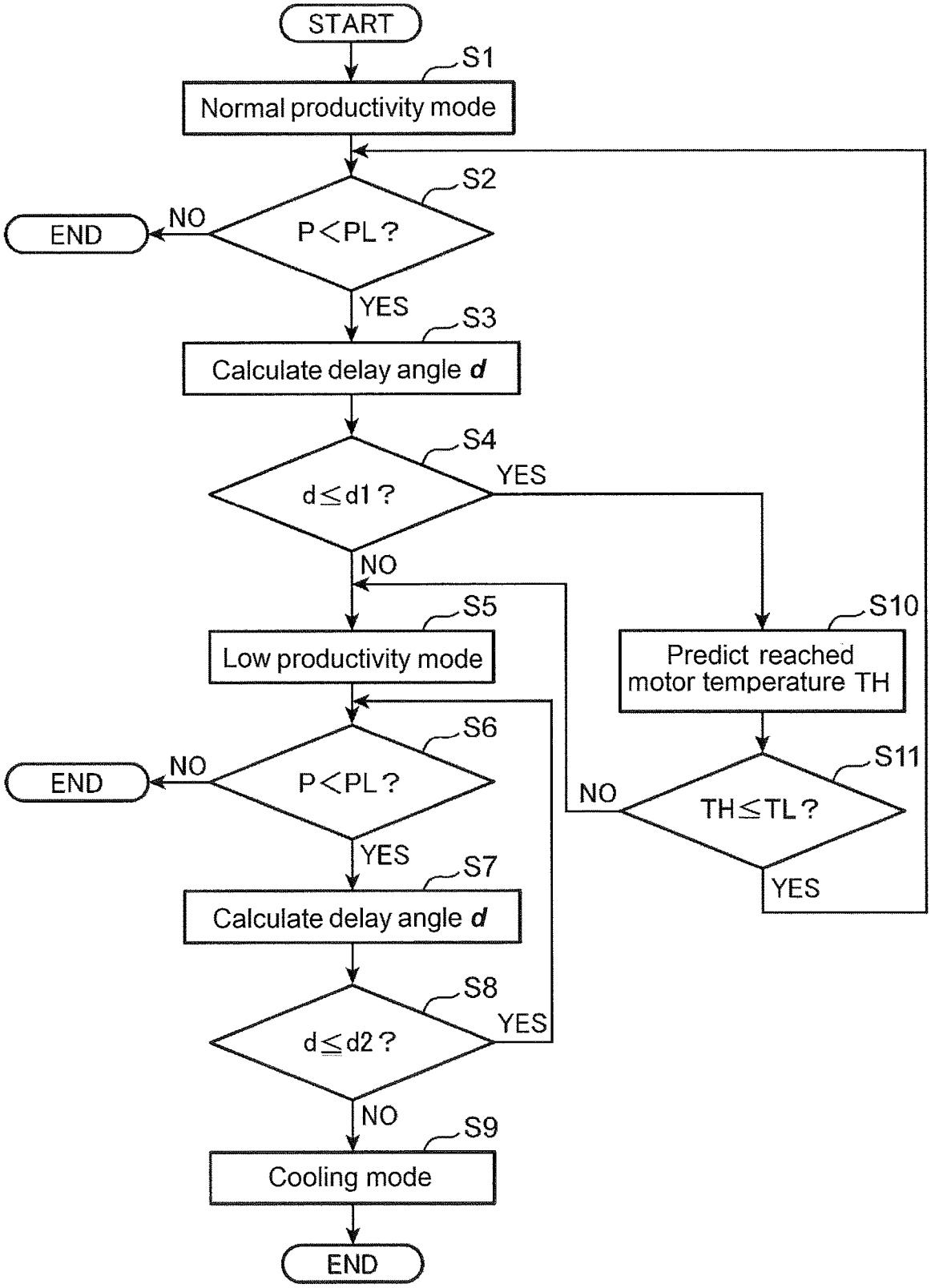
FIG. 10 illustrates a flowchart of a mode control executed in the image forming apparatus according to the one embodiment

FIG. 10 illustrates a flowchart of the mode control executed by the control unit 50 of the image forming apparatus 1 according to the embodiment. When a count of job printed sheet PL is input via the input unit 61 of the image forming apparatus 1 and a predetermined start button is pressed, the image forming operation of the image forming apparatus 1 starts. In this respect, the mode control unit 53 of the control unit 50 has the image forming mode initially set to the normal productivity mode (Step S1). The image formation control unit 51 compares a magnitude relationship between a current count of image formation completed sheet P and the count of job printed sheet PL (Step S2). When the count of image formation completed sheet P reaches the count of job printed sheet PL, the image forming operation is finished (NO at (Step S2). When the count of image formation completed sheet P is less than the count of job printed sheet PL (YES at Step S2), the delay amount detector 54 calculates the delay angle d (rotation delay amount) from a difference between the input signal of the motor drive control unit 52 and the rotation speed signal of the paper feeding motor 31M (Step S3).

Furthermore, the delay amount detector 54 compares a magnitude relationship between the detected delay angle d and a threshold value d1 (a first threshold value) (Step S4). The threshold value d1 is preliminarily set to determine transition to the low productivity mode and is stored in the storage unit 57. At Step S4, when the delay angle d is larger than the threshold value d1 (NO at Step S4), the mode control unit 53 transitions from the normal productivity mode to the low productivity mode, and the image forming operation is continued. As described above, in the low productivity mode, increasing the sheet spacing gives a margin in the rise time for the rotation of the paper feeding motor 31M.

Even in the low productivity mode, the image formation control unit 51 compares a magnitude relationship between the current count of image formation completed sheet P and the count of job printed sheet PL (Step S6). When the count of image formation completed sheet P reaches the count of job printed sheet PL, the image forming operation is finished (NO at Step S6). When the count of image formation completed sheet P is less than the count of job printed sheet PL (YES at Step S6), the delay amount detector 54 calculates the delay angle d again (Step S7). Then, the delay amount detector 54 compares a magnitude relationship between the detected delay angle d and a threshold value d2 (a second threshold value) (Step S8). The threshold value d2 is preliminarily set to determine transition to the cooling mode and is stored in the storage unit 57. At Step S8, when the delay angle d is larger than the threshold value d2 (NO at Step S8), the mode control unit 53 transitions from the low productivity mode to the cooling mode, and the image forming operation is forcibly finished. As described above, after a lapse of a preliminarily set suspension time, the image forming operation may be resumed.

On the other hand, at Step S8, when the delay angle d is less than the threshold value d2 (YES at Step S8), the low productivity mode is continued returning to Step S6.

Figure 11:
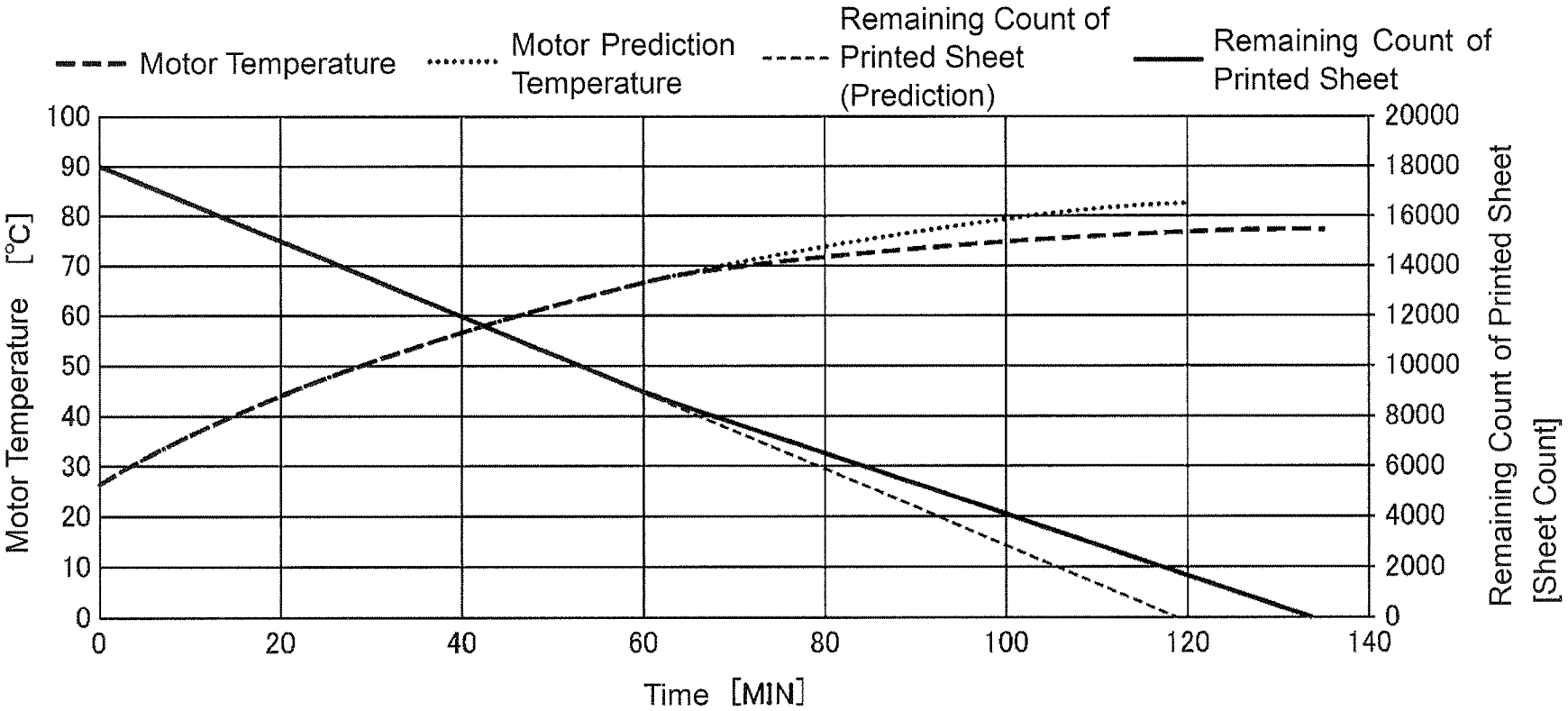
FIG. 11 illustrates a graph illustrating transitions of temperature of the brushless motor and remaining count of printed sheet during the continuous image formation in the image forming apparatus according to the one embodiment.

At Step S4, when the delay angle d is less than the threshold value d1 (YES at Step S4), the image forming operation with the normal productivity mode is continued. Here, in this embodiment; the procedure proceeds to Step S10 to execute a predictive control of a reached motor temperature TH. FIG. 11 illustrates a graph illustrating transitions of temperature of the brushless motor and remaining count of printed sheet during the continuous image formation, and a state where the predictive control of the reached motor temperature TH is executed in the image forming apparatus 1. In FIG. 11, at Time 60 (min), Step S10 in FIG. 10 is executed. At Step S10, the temperature predictor 56 (see FIG. 3) of the control unit 50 predicts the temperature of the paper feeding motor 31M when the image formation for the count of job printed sheet PL is finished (120 min in FIG. 11) from an inclination of a rise in the delay angle din the past. In the predicted value in FIG. 11, the prediction temperature TH of the paper feeding motor 31M after 120 (min) exceeds a preliminarily set threshold temperature TL (80° C.) (NO at Step S11 in FIG. 10). In view of this, the mode control unit 53 transitions to the low productivity mode, and Step S5 and later steps are executed. On the other hand, at Step S11, when the prediction temperature TH of the paper feeding motor 31M does not exceed the preliminarily set threshold temperature TL (80° C.) (YES at Step S11), the normal productivity mode at Step S2 and later steps is continued. With such control, a necessity to execute the cooling mode before the image forming operation for the count of job printed sheet PL is completed is reduced. Accordingly, at least a print job currently in execution can be executed till end.

As described above, in this embodiment, the image formation control unit 51 controls the motor drive control unit 52 to sequentially perform an on and off control of the brushless motors corresponding to the respective sheets, and adjusts the sheet spacing and the rise time in the on control of the brushless motors corresponding to the delay angle d detected by the delay amount detector 54 during the continuous image formation. Especially, the image formation control unit 51 increases the sheet spacing and performs the on control of the brushless motors so as to increase the rise time of the brushless motors when the delay angle d detected by the delay amount detector 54 exceeds the preliminarily set threshold value d1 during the continuous image formation (low productivity mode). In view of this, a generation of the sheet conveyance failure based on the torque variation of the brushless motor due to a variation of the delay angle d can be reduced. Especially, even when the rotation delay amount of the brushless motor increases, the rise time of the motor can have the margin. In view of this, the generation of the sheet conveyance failure due to a further increase of the rotation delay amount is reliably reduced.

The image formation control unit 51 temporarily stops the image forming operation in the image forming unit 903 and the rotation of the brushless motors when the delay angle d detected by the delay amount detector 54 exceeds the preliminarily set threshold value d2 after the sheet spacing is increased during the continuous image formation (cooling mode). In view of this, stopping the image forming operation, when the rotation delay amount of the brushless motor increases after the sheet spacing is increased, ensures the reduced overloaded sheet conveyance and the conveyance failure. After going through the temperature decrease or a refurbishing operation of the motor by stopping, the image forming operation can be stably resumed.

Furthermore, the image formation control unit 51 predicts a value of the operation property value when the image forming operation for the count of job printed sheet PL is finished from information on the temperature of the paper feeding motor 31M predicted by the temperature predictor 56 or the delay angle d (operation property value) and information on the latest count of image formation completed sheet P. When this predicted operation property value exceeds the preliminarily set property value threshold, the image formation control unit 51 adjusts the sheet spacing and the rise time in the on control of the brushless motor. In this respect, the image formation control unit 51 increases the sheet spacing and performs the on control of the brushless motor so as to increase the rise time to avoid the operation property value when the image forming operation for the count of job printed sheet PL is finished exceeding the property value threshold. In view of this, the operation property value of the brushless motor largely exceeding the property value threshold can be reduced. At least the print job currently in execution can be executed till end. Thus, in this embodiment, while performing prediction management of the temperature of the brushless motor, the images can be stably formed.

The disclosure is not limited to these embodiments, for example, the following modified embodiment can be employed.

Figure 12:
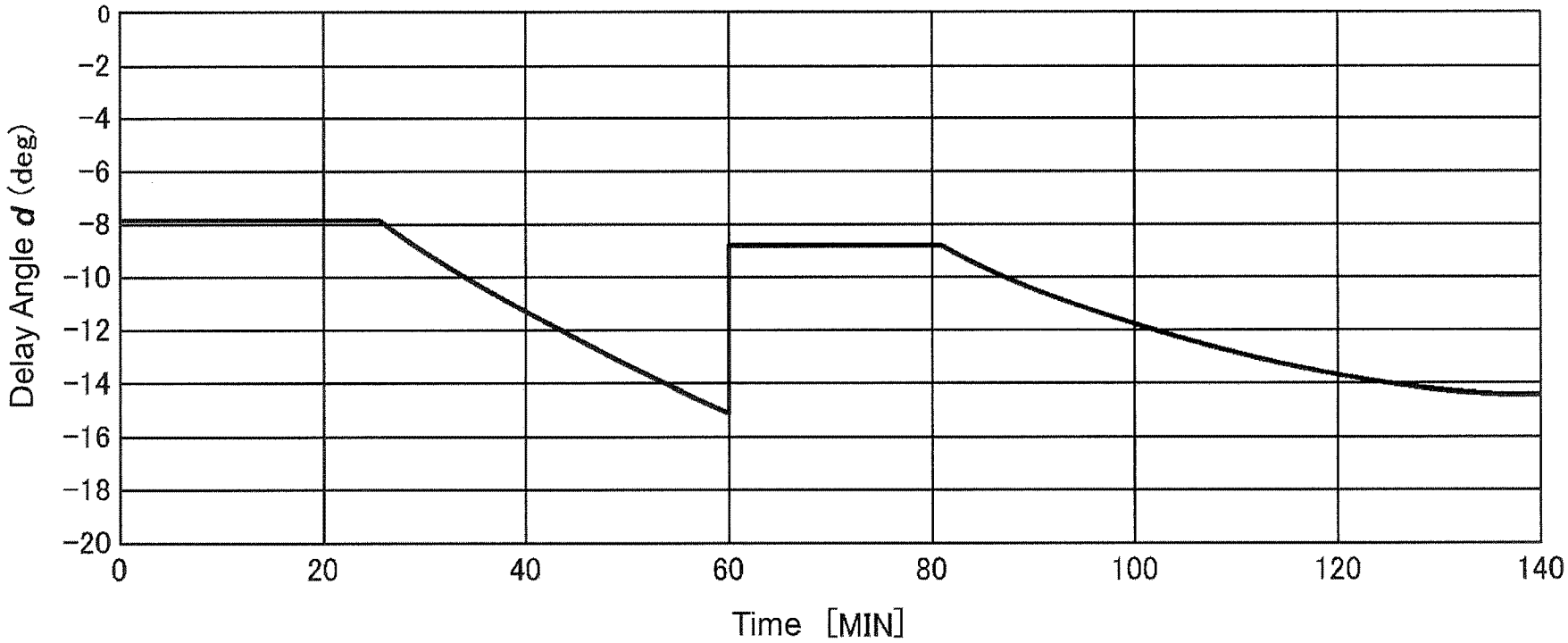
FIG. 12 illustrates a graph illustrating transitions of rotation delay amount of the brushless motor during the continuous image formation in an image forming apparatus according to a modified embodiment.

(1) In the above-described embodiment, while a description has been given of the aspect in which the mode control unit 53 transitions from the normal productivity mode to the low productivity mode, and further to the cooling mode corresponding to the delay angle d, the disclosure is not limited to this. There may be a case where the mode control unit 53 transitions from the normal productivity mode to the cooling mode. FIG. 12 illustrates a graph illustrating transition of rotation delay amount of the brushless motor during the continuous image formation in the image forming apparatus according to the modified embodiment of the disclosure. As illustrated in FIG. 12, when the delay angle d rapidly increases and exceeds the predetermined threshold (15 deg in FIG. 12) (the fourth threshold value), the information output unit 55 (see FIG. 3) may output the failure information on the brushless motor or another member (for example, a gear coupled to the brushless motor) connected to this brushless motor. In this case, in association with a significant increase of the delay angle d, the failure information on, for example, the brushless motor can be notified. The failure information output here may be notified to the user of the image forming apparatus 1 and a maintenance worker by being output to and displayed on the display 62, or may be transmitted to a preliminarily set destination (an administrator and the information management center) via the network (see FIG. 3) (a communication line). In the case of the latter, this information can request the maintenance worker to visit. The above-described fourth threshold value is preferred to be set larger than the above-described second threshold value. As illustrated in FIG. 12, when the delay angle d (for example, 10 deg) larger than normal is constantly generated instead of a trend where the delay angle d of the paper feeding motor 31M gradually increases, the aspect may have the information output unit 55 transmitting caution needed information to the display 62 and the administrator.

(2) The image forming mode set by the mode control unit 53 is not limited to the normal productivity mode and the low productivity mode. As one example, the image formation control unit 51 may temporarily decelerates the image forming operation in the image forming unit 903 and the rotation speed of the brushless motor when the delay angle d detected by the delay amount detector 54 exceeds a preliminarily set threshold value (a third threshold value) during the continuous image formation (a deceleration mode). In this mode, the target rotation speeds themselves of the respective conveyance rollers of the conveyance unit 3 are set low. Also in this case, while reducing the increase of the delay angle d of the conveyance motor, the conveyance and the image formation of the sheet can be stably continued.

(3) In the above-described embodiment, a description has been given by using the temperature of the motor as the operation property value of the brushless motor that has the influence on the rotation delay amount (the delay angle d), the disclosure is not limited to this. When a cause of the generation of the delay angle (a phase difference) in the brushless motor is a variation of an output torque of the motor, a temporal cause can include a rise of the motor temperature and a power source failure (voltage drop). The case where the above-described cause exists in a load side coupled to the brushless motor can include cases of a gear abrasion, a roller abrasion, and a sheet (paper sheet) setting error (a paper sheet actually sent out is different from a paper sheet set in the input unit 61). In any case, when the delay angle d of the brushless motor is influenced, the image forming operation is configured to be controlled to continue or stop, abort as described above.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed is:

1. An image forming apparatus comprising:

at least one conveyance roller pair that includes a conveyance roller and a facing roller, the conveyance roller being rotationally driven at a predetermined rotation speed to convey sheets, the facing roller that forms a nip portion with the conveyance roller through which the sheets pass;

an image forming unit that forms images on the sheets conveyed by the conveyance roller pair;

at least one brushless motor that outputs a rotation speed signal, the brushless motor generating a rotary drive power that rotationally drives the conveyance roller;

a motor drive control unit that outputs an input signal corresponding to the rotation speed of the conveyance roller to the brushless motor to control the brushless motor;

a delay amount detector that detects a rotation delay amount of the brushless motor from the input signal and the rotation speed signal; and an image formation control unit that controls the image forming unit so as to form predetermined images, the image formation control unit controlling the motor drive control unit to convey the sheets at a predetermined timing toward the image forming unit, wherein the image formation control unit, during a continuous image formation in which a plurality of sheets are continuously conveyed by the conveyance roller pair with a predetermined sheet spacing and images are sequentially formed on the respective sheets, controls the motor drive control unit to sequentially perform an on and off control of the brushless motor corresponding to the respective sheets, and adjusts the sheet spacing and a rise time in the on control of the brushless motor corresponding to the rotation delay amount detected by the delay amount detector.

2. The image forming apparatus according to claim 1, wherein the image formation control unit increases the sheet spacing and performs the on control of the brushless motor so as to increase the rise time when the rotation delay amount detected by the delay amount detector exceeds a preliminarily set first threshold value during the continuous image formation.

3. The image forming apparatus according to claim 2, wherein the image formation control unit forcibly stops the image forming operation in the image forming unit and the rotation of the brushless motor when the rotation delay amount detected by the delay amount detector exceeds a preliminarily set second threshold value after the sheet spacing is increased during the continuous image formation.

4. The image forming apparatus according to claim 2, wherein the image formation control unit temporarily decelerates the image forming operation in the image forming unit and the rotation speed of the brushless motor when the rotation delay amount detected by the delay amount detector exceeds a preliminarily set third threshold value after the sheet spacing is increased during the continuous image formation.

5. The image forming apparatus according to claim 1, further comprising an information output unit that outputs failure information on the brushless motor or another member connected to the brushless motor when the rotation delay amount detected by the delay amount detector exceeds a preliminarily set fourth threshold value.

6. The image forming apparatus according to claim 5, further comprising a display that displays the failure information output by the information output unit.

7. The image forming apparatus according to claim 5, wherein the information output unit transmits the failure information to a preliminarily set destination via a predetermined communication line.

8. The image forming apparatus according to claim 1, further comprising:

a storage unit that preliminarily stores relationship information between the rotation delay amount of the brushless motor and an operation property value of the brushless motor; and a property value predictor that predicts the operation property value of the brushless motor from the rotation delay amount detected by the delay amount detector and the relationship information stored in the storage unit.

9. The image forming apparatus according to claim 8, further comprising an input unit that accepts an input of a count of job printed sheet as a count of sheet of the plurality of sheets on which images are continuously formed during the continuous image formation, wherein the image formation control unit predicts a value of the operation property value when the image forming operation for the count of job printed sheets is finished from information on the operation property value predicted by the property value predictor and information on a latest count of image formation completed sheets, the image formation control unit adjusting the sheet spacing and the rise time in the on control of the brushless motors when the predicted operation property value exceeds a preliminarily set property value threshold.

10. The image forming apparatus according to claim 9, wherein the image formation control unit increases the sheet spacing and performs the on control of the brushless motor so as to increase the rise time to avoid the operation property value, when the image forming operation for the count of job printed sheet is finished, exceeding the property value threshold.

11. The image forming apparatus according to claim 8, wherein the operation property value of the brushless motor includes a temperature of the brushless motor.

* * * * *